United States Patent [19]

Mavis

[11] 4,236,270

[45] Dec. 2, 1980

[54] WINDOW CLEANING DEVICE

[76] Inventor: Michael J. Mavis, P.O. Box 23331, San Diego, Calif. 92123

[21] Appl. No.: 54,144

[22] Filed: Jul. 2, 1979

[51] Int. Cl.[3] ..... A47L 1/08

[52] U.S. Cl. ..... 15/245; 15/144 R; 15/145; 15/244 A

[58] Field of Search ..... 15/144 R, 143 A, 145, 15/245, 176, 236 R, 144 A, 244 A

[56] References Cited

U.S. PATENT DOCUMENTS

| | | | |
|---|---|---|---|
| 2,230,583 | 2/1941 | Borden | 15/245 |
| 3,408,676 | 11/1968 | Cayo | 15/245 X |

FOREIGN PATENT DOCUMENTS

| | | | |
|---|---|---|---|
| 2510150 | 5/1976 | Fed. Rep. of Germany | 15/245 |

*Primary Examiner*—Edward L. Roberts
*Attorney, Agent, or Firm*—Tom Sherrard

[57] ABSTRACT

A device having angular and rotatable linkage between a handle and squeegee blade for manipulating the blade on the surface of glass being cleaned.

1 Claim, 4 Drawing Figures

FIG. 1
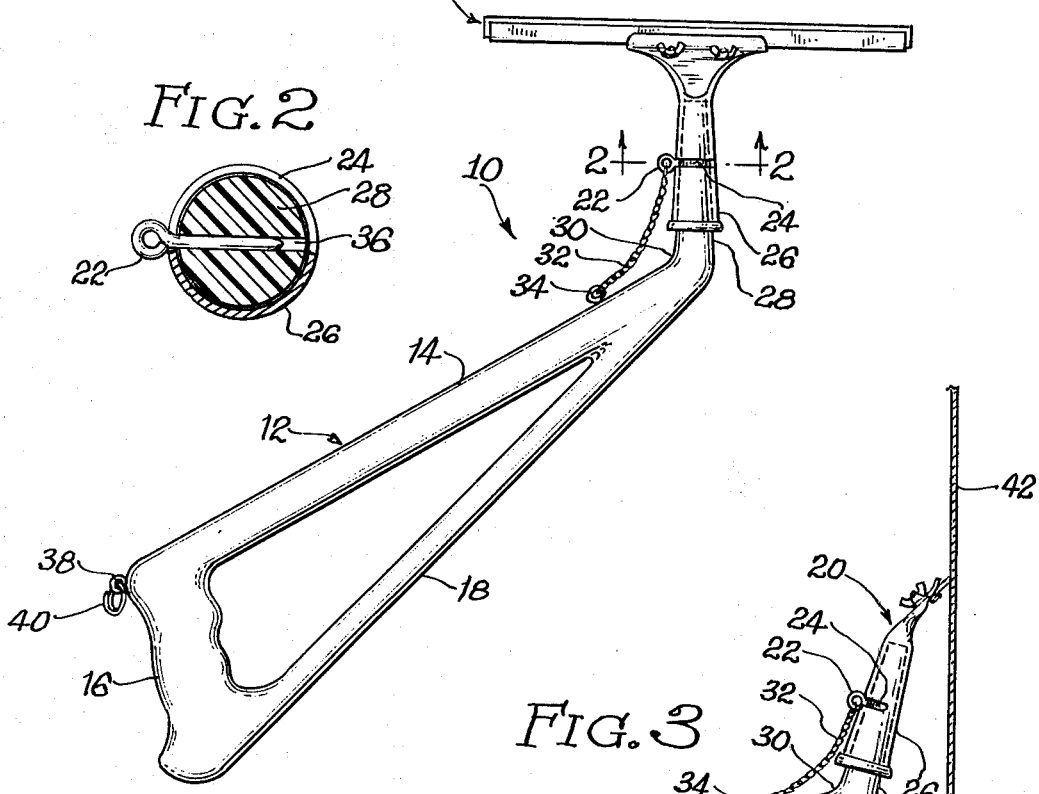
FIG. 2
FIG. 3
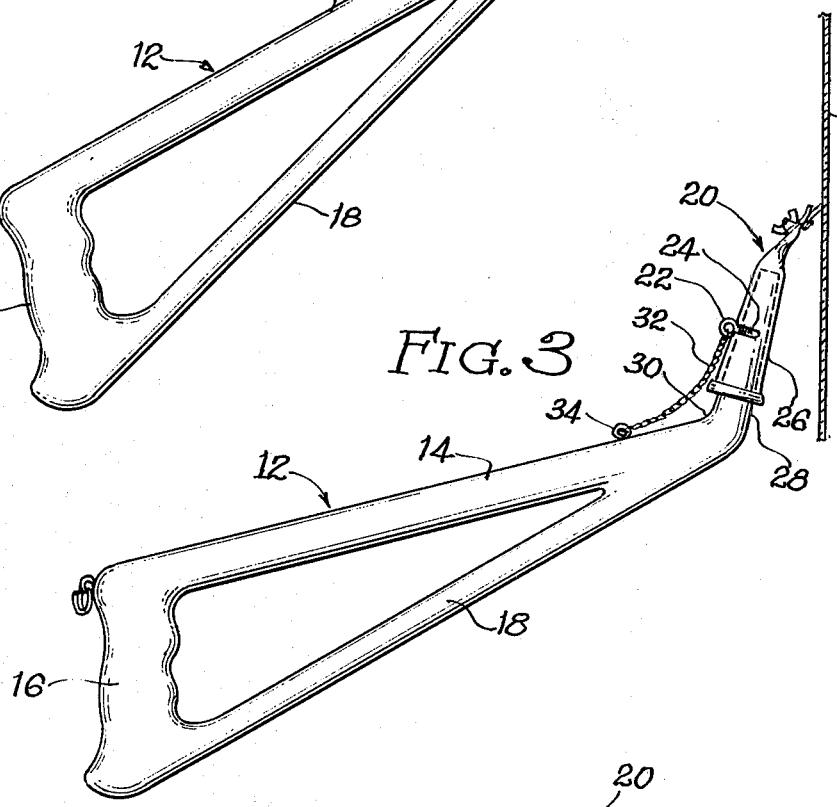
FIG. 4
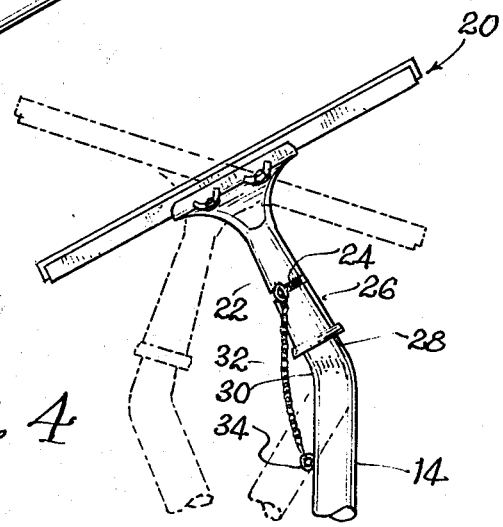

WINDOW CLEANING DEVICE

BACKGROUND OF THE INVENTION

This invention pertains to devices for cleaning conventional smooth glass building window surfaces of many and various shapes, dimensions and degrees of accessibility. There are shortcomings in the usual arrangements. Although the straight pole is not uncommon as a squeegee attachment, there is much to be desired. The blade which contacts the glass must be wiped frequently during use. If not wiped, dirt settling thereon will come off on the window causing undesirable streaks. The usual straight stick handles, if long enough to reach high windows, do not permit easy wiping of the blade, due to the end of a long blade contacting the floor. Also, a straight stick handle prevents desired turning, under pressure, of the blade on the glass. Without having a wrist-like action in the handle it is difficult to sweep or slide the water to the edge of windows when access to the window is impaired.

SUMMARY

My invention has overcome these deficiencies. By having an angular connecting member between the handle and conventional squeegee and a rotatable connection between the member and the squeegee unit, I have accomplished the surprising result of being able to maintain desired constant and uniform pressure of the blade against the glass while maneuvering the device from many and various positions in respect to the glass. With my invention it is no longer as difficult to clean windows which are high, near a wall or have an obstruction between the operator and window, or a combination of these usual impediments. A person can work with one continuous motion. This is a very important unique result. Furthermore, the blade on my device can easily be wiped between contacts with the glass without having a handle touch the floor.

A special feature of my device is the removable pin means between the squeegee portion and the angular connecting member. It permits the squeegee portion to be easily separated from the more novel portion whereby the squeegee can be used at any time without a handle.

BRIEF DESCRIPTION OF THE DRAWINGS

In the drawing forming a part hereof:

FIG. 1 is a top plan view of the device.

FIG. 2 is a cross-sectional detail of the end of the angular member positioned in the tubular handle of a squeegee with a retaining pin in place. It is taken along line 2—2 of FIG. 1.

FIG. 3 is a side elevation showing the blade contacting glass as in cleaning.

FIG. 4 is a top plan view of the angular section of the connecting member and squeegee portion showing the maneuverability of my invention.

DESCRIPTION OF PREFERRED EMBODIMENT

Again referring to the accompanying drawing wherein like numerals represent like parts throughout, the numeral 12 points to the entire handle and connecting parts to my invention 10 of FIG. 1. There is main beam 14 of the important angular connecting member. It has a handle 16 integral with one end at right angles thereto. Also integral therewith is diagonal brace or strut 18. Items 14 and 18 join and the resulting single beam is bent at an angle, preferably 120 degrees, shown as item 30. This tapers to cylindrical end 28. At the opposite end at the joinder of the handle and beam are eyelet 38 holding ring 40 for easy attachment and release from the clothing of the operator when the handle and described assembly are not being used, i.e. when the squeegee portion is used in the conventional manner.

Through the single beam near the tapered end is channel 36 to receive snug fitting pin 22. When not in place it is held by chain 32 held by eyelet 34 on beam 14.

There is novel slot 24 more than half way round the circumference of the tapered tubular open end section 26 of conventional squeegee portion 20. This arrangement permits control of the blade on glass 42 at all times and under all circumstances. With this device a person can do at a distance what could otherwise be done only with the wrist next to the blade. It is like an extension of the human arm.

Those skilled in the art may make obvious changes which will be within the scope of the subjoined claims.

I claim:

1. A squeegee assembly comprising a tubular handle section provided with a gripping portion integral therewith at one end thereof, said parts being angled in respect to each other; a tapered portion integral with the other end of the handle section, said tapered portion also being angled in respect to the handle section whereby the gripping portion and the tapered portion extend in substantially opposite directions in a substantially parallel space relationship to each other; a squeegee rotatably mounted on the tapered portion; a slot cut transversally through a portion of the squeegee handle and a pin mounted through the slot and slidably retained in an orifice in the tapered portion.

* * * * *